US007681389B2

(12) United States Patent
Preutenborbeck et al.

(10) Patent No.: US 7,681,389 B2
(45) Date of Patent: Mar. 23, 2010

(54) SUCTION AIR NOZZLE FOR A TEXTILE MACHINE

(75) Inventors: Maximilian Preutenborbeck, Mönchengladbach (DE); Wilhelm Oehrl, Erkelenz (DE); Detlef Schelter, Erkelenz (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 106 days.

(21) Appl. No.: 12/084,713

(22) PCT Filed: Nov. 13, 2006

(86) PCT No.: PCT/EP2006/010856

§ 371 (c)(1),
(2), (4) Date: May 8, 2008

(87) PCT Pub. No.: WO2007/059877

PCT Pub. Date: May 31, 2007

(65) Prior Publication Data

US 2009/0120053 A1 May 14, 2009

(30) Foreign Application Priority Data

Nov. 23, 2005 (DE) ..... 10 2005 055 717

(51) Int. Cl.
*D01H 4/50* (2006.01)

(52) U.S. Cl. ..... 57/263

(58) Field of Classification Search ..... 57/22, 57/261, 262, 263, 305; 242/417.1, 475.1, 242/475.2, 475.3, 475.4
See application file for complete search history.

(56) References Cited

U.S. PATENT DOCUMENTS

| | | | | | |
|---|---|---|---|---|---|
| 4,083,171 | A | * | 4/1978 | Konig et al. | 57/263 |
| 4,121,409 | A | * | 10/1978 | Uchida et al. | 57/22 |
| 4,223,518 | A | | 9/1980 | Karl et al. | 57/263 |
| 4,356,692 | A | * | 11/1982 | Karl et al. | 57/263 |
| 4,372,503 | A | * | 2/1983 | Kincheloe et al. | 242/412.3 |
| 4,972,668 | A | | 11/1990 | Stahlecker | 57/261 |
| 5,272,862 | A | | 12/1993 | Stahlecker et al. | 57/22 |
| 2004/0221909 | A1 | | 11/2004 | Horibe et al. | 139/11 |

FOREIGN PATENT DOCUMENTS

| | | |
|---|---|---|
| DE | 1 785 321 | 6/1971 |
| DE | 2 221 316 | 9/1973 |
| DE | 28 02 913 | 11/1978 |
| DE | 3829 151 A1 | 3/1990 |
| DE | 40 27210 A1 | 3/1992 |
| EP | 1 207 225 A2 | 5/2002 |
| EP | 1 441 053 A1 | 7/2004 |
| FR | 2 667 581 | 4/1992 |
| GB | 1 435 717 | 5/1972 |

* cited by examiner

*Primary Examiner*—Shaun R Hurley
(74) *Attorney, Agent, or Firm*—K&L Gates LLP

(57) ABSTRACT

A suction air nozzle for a textile machine for storing a yarn length of a running yarn passing the nozzle opening. The nozzle has an elongate nozzle body, with a clear cross section having a narrower width in the region of its central longitudinal axis than in its tube-like edge regions. The nozzle further has an inlet opening, which has its largest width in the yarn running direction. The clear cross section of the nozzle body of the suction air nozzle increases from the inlet opening of the nozzle body in the axial direction to an end-side outlet opening.

7 Claims, 2 Drawing Sheets

SUCTION AIR NOZZLE FOR A TEXTILE MACHINE

CROSS-REFERENCES TO RELATED APPLICATIONS

This application claims the benefit of German patent application 10 2005 055 717.1, filed Nov. 23, 2005, herein incorporated by reference.

BACKGROUND OF THE INVENTION

The invention relates to a suction air nozzle for a textile machine for storing a yarn length of a running yarn passing the nozzle opening.

Suction air nozzles of this type have been known for a long time in conjunction with spinning machines or winding machines or the service units associated with these textile machines and are described in numerous patent applications.

Suction air nozzles of this type are used, for example, to keep the yarn tension constant during the winding operation or are used, for example, in spinning machines to store the temporarily occurring yarn excess when running the workstations up to operating speed and to supply it successively to the winding device of the relevant workstation.

A textile machine is described in German Patent Publication DE-OS 1 785 321, in which a suction air nozzle is positioned in the yarn running direction shortly before the winding device, right next to the regular yarn running path. The suction air nozzle has, in the region of its inlet opening, an upper and a lower deflection roller, in each case, and pneumatically loads the running yarn in such a way that a yarn loop reaching into the suction air nozzle is formed between the deflection rollers. In other words, the suction air nozzle ensures that the yarn is always wound at a sufficiently great yarn tension onto a winding device.

German Patent Publication DE 40 27 210 A1 describes an air spinning machine, the workstations of which are supplied by an automatically operating service unit.

Both the moveable service unit and the workstations of the air spinning machine are in each case equipped with suction air nozzles. As already mentioned, the yarn excess occurring when workstations of this type are run up to operating speed is to be temporarily intermediately stored by means of the suction air nozzle arranged in the region of the workstations.

A similar suction air nozzle for temporarily receiving a relatively large quantity of yarn is also described in German Patent Publication DE-AS 22 21 316 using the example of an open-end spinning machine, or in European Patent Publication EP 1 207 225 A2, which shows the use of a suction air nozzle of this type on an air spinning machine.

The suction air nozzles described in the aforementioned literature references generally have inlet openings, which have their greatest extension in the yarn running direction, with, as can be seen, for example, from German Patent Publication DE-OS 1 785 321 or European Patent Publication EP 1 207 225 A2, the height of the inlet opening clearly exceeding its width. In these known suction air nozzles, the clear cross section of the nozzle body, which substantially corresponds to the size and shape of the inlet opening, is constant from the inlet opening to an outlet opening in the region of a suction air connection.

The disadvantage in these known suction air nozzles is not only their lack of suction force, but, in these suction air nozzles, there is always the risk, despite an elongate cross section in the yarn running direction that the sucked-in yarn loop may become twisted or form knots which may appreciably disturb the operation of the workstations.

It has therefore already been proposed to modify the shape of such suction air nozzles or the clear cross section of suction air nozzles of this type in such a way that the risk of knot formation is reduced.

German Patent Publication DE 28 02 913 A1 describes, for example, a suction air nozzle, the nozzle body of which has a constriction on its entire length, by means of which its clear cross sectional area is divided into two partial areas. The diameter of the suction air nozzle is thus only about half as large in the region of the constriction as in the region of the two partial areas.

Furthermore, suction air nozzles are known from German Patent Publication DE 38 29 151 A1, the nozzle bodies of which are curved in the axial direction. The clear cross sectional face also has lateral partial faces here, in which the yarn strands of a yarn loop which has been sucked in are to be deposited in a defined manner.

It was possible to slightly ameliorate the problem of knot formation in the case of long yarn loops by means of suction air nozzles, such as are known from German Patent Publications DE 28 02 913 A1 or DE 38 29 151 A1, but suction air nozzles of this type continue to have the disadvantage that, in particular long yarn loops inside the suction air nozzle are not adequately reliably tensioned because of lack of suction force or inadequate suction force distribution.

SUMMARY OF THE INVENTION

Proceeding from the aforementioned prior art, the invention is based on the object of developing a suction air nozzle, which ensures that even relatively long yarn loops are reliably positioned in the suction air nozzle at all times and are thus deposited in such a way that knots or the like are reliably avoided.

This object is achieved according to the invention by a suction air nozzle for a textile machine for storing a yarn length of a running yarn passing the nozzle opening. The suction air nozzle has an elongate nozzle body, with a clear cross section having a narrower width in the region of its central longitudinal axis than in its tube-like edge regions. The nozzle further has an inlet opening, which has its largest width in the yarn running direction. According to the invention, the clear cross section of the nozzle body of the suction air nozzle increases from the inlet opening of the nozzle body in the axial direction to an end-side outlet opening.

Advantageous further configurations of the invention are described more fully hereinafter.

The embodiment according to the invention of a suction air nozzle with a nozzle body, the clear cross section of which increases from an inlet opening in the axial direction to an end-side outlet opening, has various advantages. While the workstation is being run up to operating speed, the yarn excess produced is sucked in as a yarn loop, for example, which is pulled apart with increasing yarn length and this considerably reduces the risk of knot formation. At the same time, the yarn loop which is becoming wider also forms a larger engagement face for the reduced pressure flow, which leads to very stable positioning of the yarn loop in the suction air nozzle and therefore to adequate yarn tension.

It is provided in an advantageous embodiment that the enlargement of the clear cross section of the nozzle body takes place continuously. Such a continuous enlargement of the clear cross section leads to a very uniform increase in the effective holding force in the suction air nozzle, which has a positive effect on the yarn loop. In other words, the yarn strands of the yarn loop run, although they are loaded by a relatively large suction force, into the edge regions of the nozzle body in a manner which is gentle on the yarn.

Not only the clear cross section of the central region, which has parallel side walls, becomes continuously larger in the direction of the outlet opening of the nozzle body, but so, too, does the clear cross section of the edge regions. In particular, the continuous, clear increase in the clear cross section of the edge regions leads to a calming of the suction air flow in these regions with the result that the yarn strands of the sucked-in yarn loop run in a relatively gentle manner along the walls of the edge regions.

It is also provided in an advantageous configuration of the invention that the tubular edge regions run in a divergent manner in the direction of the outlet opening of the nozzle body. A configuration of this type leads to a continuous enlargement of the clear cross section of the central region of the nozzle body, which has a positive effect both on the receiving volume of the suction air nozzle and on the suction force acting on the yarn.

A guide contour with side walls is arranged in the region of the inlet opening of the suction air nozzle, between which side walls the yarn runs. The side walls are outwardly curved here at the front. The guide contour ensures that the yarn, which, during regular spinning operation, in other words, while the yarn produced in the spinning device is wound on the winding device to form a cross-wound bobbin, runs at a slight spacing in front of the inlet opening of the suction air nozzle, if necessary, in other words, it is reliably sucked into the suction air nozzle while the workstation is run up to operating speed.

The convex curvature of the side walls ensures here that the yarn is always guided exactly in front of the inlet opening of the suction air nozzle during the spinning operation.

BRIEF DESCRIPTION OF THE DRAWINGS

The invention will be described in more detail below with the aid of an embodiment shown in the drawings, in which.

DETAILED DESCRIPTION OF THE PREFERRED EMBODIMENTS

Figure 1:
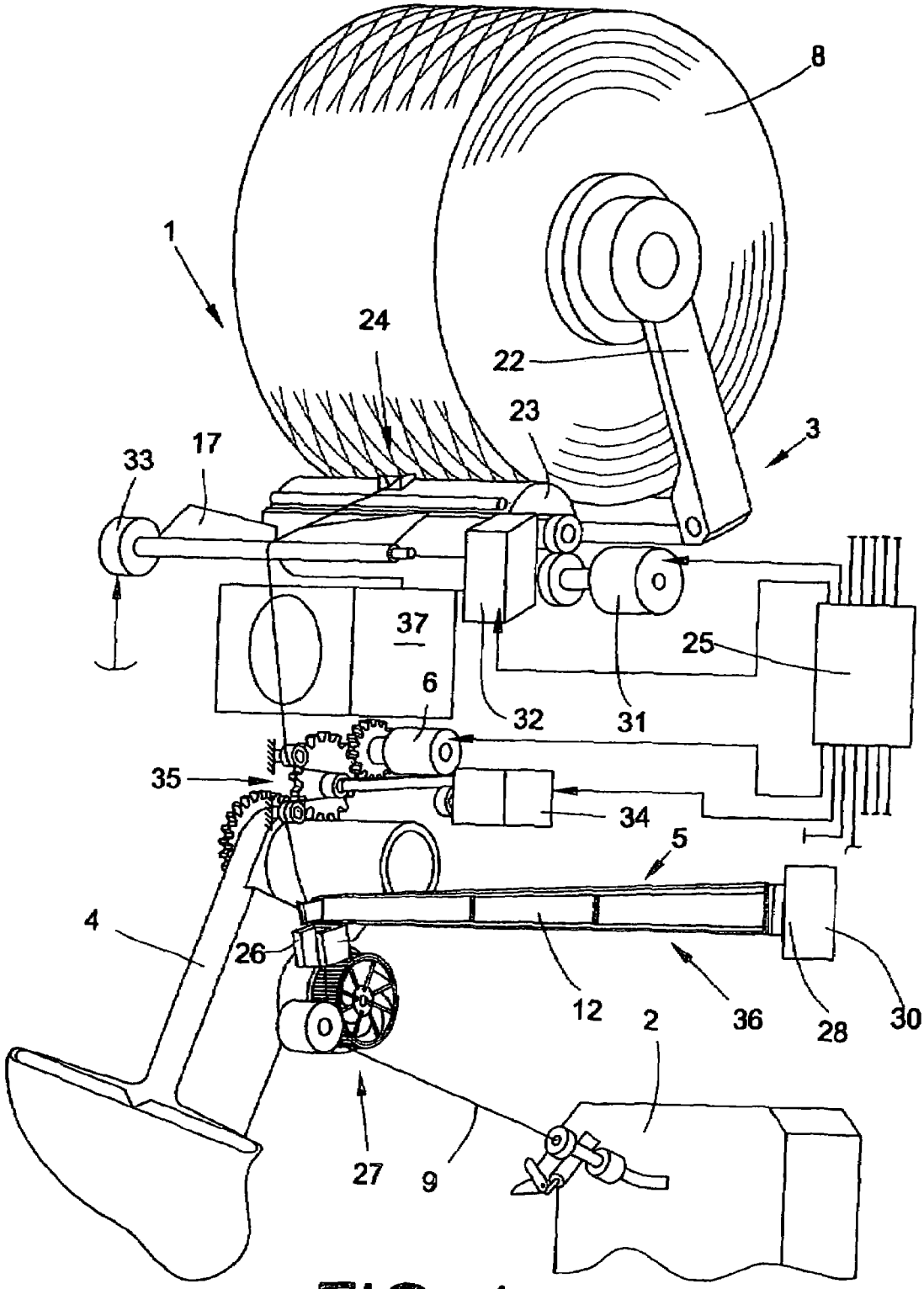
FIG. 1 shows a workstation of an open-end spinning machine with a suction air nozzle according to the invention for temporary storage of a yarn loop.

FIG. 1 shows a perspective view of a workstation, designated as a whole by the reference numeral 1, of an open-end rotor spinning machine. Workstations 1 of this type, as known, have a large number of workstation components which allow the production of a yarn 9 and the production of a cross-wound bobbin 8. Such workstations, for example, have an open-end spinning device 2 and a winding device 3.

Furthermore, workstations of this type have a yarn draw-off mechanism 27, which takes over the drawing off of the yarn 9 from the open-end spinning device 2 during regular spinning operation and also, during repiecing, ensures the return of the yarn end of the yarn 9 returned from the cross-wound bobbin 8 into the open-end spinning device 2.

The winding mechanism 3 itself consists, as indicated in FIG. 1, of a creel 22 for the rotatable holding of a cross-wound bobbin 8, a drive drum 23 which can preferably be driven by means of a reversible single drive 31, and a yarn traversing device 24, which is driven, for example, by a stepping motor 32. In the embodiment, a yarn centering mechanism in the form of a pivotably mounted centering plate 17 is also arranged in front of the yarn traversing mechanism 24 and, if necessary, in other words during repiecing, can be folded into the regular yarn running path by a drive 33, in a defined manner. Optionally, each of the workstations 1 may also be equipped with a waxing mechanism 37.

Furthermore, such workstations 1 have a pivotably mounted suction air nozzle 4, which can be adjusted in a defined manner by means of a stepping motor 6 between a yarn receiving position located in the region of the winding device 3 and a yarn transfer position located in the region of the spinning device 2. Each of the workstations 1 also has a workstation computer 25, which activates the various drives of the workstation, a stop motion 26, which, during spinning operation, monitors the correct presence of the yarn 9, a mechanical yarn storage mechanism 35, which is driven by an electric drive 34 as well as a pneumatically operating yarn storage mechanism 36. The pneumatically operating yarn storage mechanism 36 is configured here according to the invention as a reduced pressure-loadable suction air nozzle 5 which, as indicated in FIG. 1, is preferably fixed on a connection piece 28 of a reduced pressure channel 30 along the length of the machine, which is in turn connected to a reduced pressure source (not shown).

The reduced pressure-loadable suction air nozzle 5 according to the invention which, while the workstation 1 is being run up to operating speed, temporarily stores the yarn quantity which is produced as a result of different run-up speeds of the open-end spinning device 2 and winding device 3, will be described below in more detail with the aid of FIGS. 2 to 4.

Figure 2:
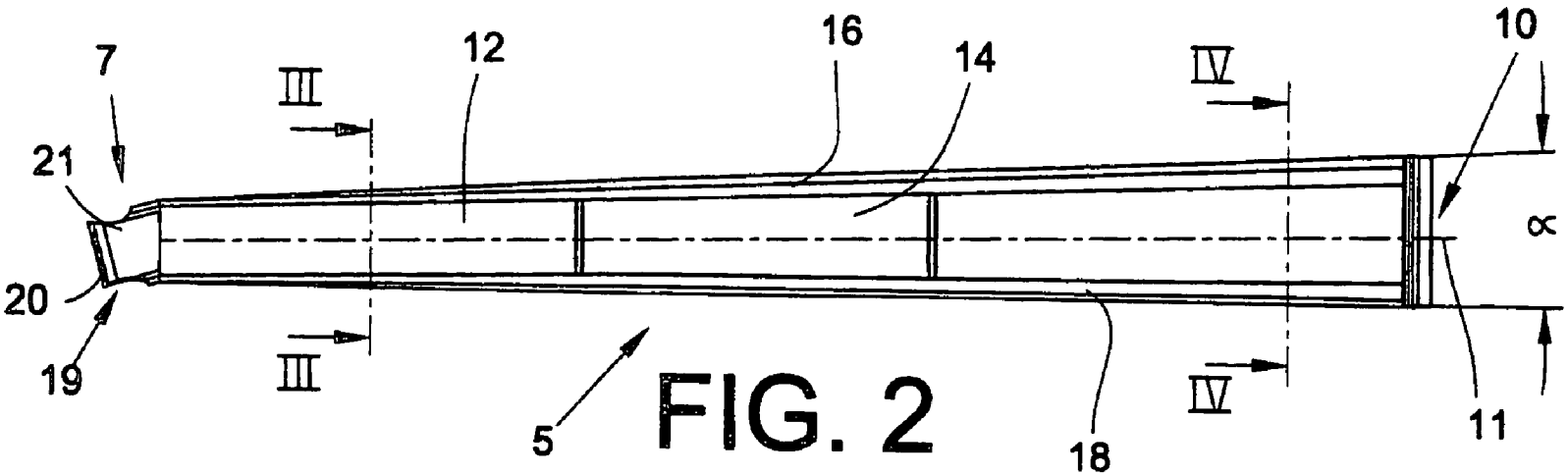
FIG. 2 shows the suction air nozzle according to the invention to a larger scale.

FIG. 2, in a side view and to a scale which is enlarged compared to FIG. 1, shows the suction air nozzle 5 according to the invention, which is produced, for example, by the injection moulding method or by the blow moulding method from plastics material. As indicated in FIG. 2, the suction air nozzle 5 consists of a nozzle body 12, which has an inlet opening 7 at the front and an outlet opening 10 at the end. Arranged in the region of the inlet opening 7 is also a guide contour 19, the side walls 20, 21 of which are slightly outwardly curved in the front region. The nozzle body 12 itself, as shown in FIGS. 3 and 4, has a central region 13 with side walls 14, 15 arranged in parallel as well as tubular edge regions 16, 18.

Figure 4:
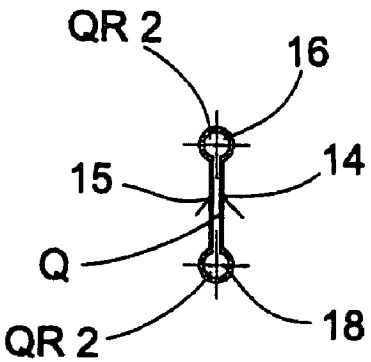
FIG. 4 shows the suction air nozzle in cross section, along the section IV-IV of FIG. 2.
Figure 3:
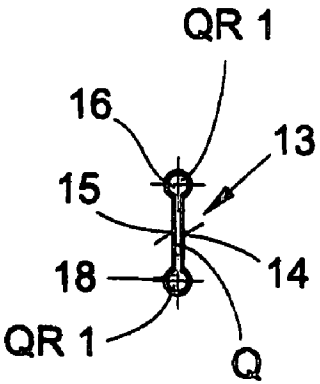
FIG. 3 shows the suction air nozzle in cross section, along the section III-III of FIG. 2.

As indicated in particular in FIG. 2 with the aid of the angle $\alpha$, the tubular edge regions 16, 18 of the nozzle body 12 run in the direction of the outlet opening 10 in a divergent manner equidistant from a longitudinal centerline 11, with the clear cross section QR thereof increasing at the same time, as shown in FIGS. 3 and 4. The clear cross section of the edge regions 16, 18 in the region of the section III-III is, for example, QR1, while the clear cross section of the edge regions 16, 18 in the region of the section IV-IV is greater and is, for example, QR2.

As can also be seen from FIGS. 3 and 4, the clear cross section also increases slightly in the central region 13. In other words, the clear overall cross section Q of the suction air nozzle 5 is smallest in the region of its inlet opening 7 and increases continuously to the outlet opening 10.

What is claimed is:

1. Suction air nozzle for a textile machine for storing a yarn length of a running yarn passing the nozzle opening, with an elongate nozzle body, which has a clear cross section, which has a narrower width in the region of its central longitudinal axis than in its tube-like edge regions, and with an inlet opening, which has its largest width in the yarn running direction, characterised in that the clear cross section (Q) of the nozzle body (12) of the suction air nozzle (5) increases from the inlet opening (7) of the nozzle body (12) in the axial direction to an end-side outlet opening (10).

2. Suction air nozzle according to claim 1, characterised in that the increase in the clear cross section (Q) of the nozzle body (12) takes place continuously.

3. Suction air nozzle according to claim 1, characterised in that the tubular edge regions (16, 18) of the nozzle body (12) have a cross section (QR), which becomes larger in the direction of the outlet opening (10) of the nozzle body (12).

4. Suction air nozzle according to claim 3, characterised in that the tubular edge regions (16, 18) of the nozzle body (12) run in a divergent manner in the direction of the outlet opening (10) of the nozzle body (12).

5. Suction air nozzle according to claim 1, characterised in that a guide contour (19) is arranged in the region of the inlet opening (7) of the suction air nozzle (5).

6. Suction air nozzle according to claim 5, characterised in that the guide contour (19) has side walls (20, 21), between which the yarn (9) runs.

7. Suction air nozzle according to claim 6, characterised in that the side walls (20, 21) are outwardly curved at the front.

* * * * *